US009074424B2

(12) United States Patent
Jonsson et al.

(10) Patent No.: US 9,074,424 B2
(45) Date of Patent: Jul. 7, 2015

(54) ROD SUPPORT SYSTEM

(75) Inventors: Andreas Jonsson, Örebro (SE); Chad Przano, Dallas, TX (US); Tim Ledbetter, Sachse, TX (US)

(73) Assignee: Atlas Copco Drilling Solutions, LLC, Garland, TX (US)

( * ) Notice: Subject to any disclaimer, the term of this patent is extended or adjusted under 35 U.S.C. 154(b) by 423 days.

(21) Appl. No.: 13/472,677

(22) Filed: May 16, 2012

(65) Prior Publication Data

US 2013/0306378 A1 Nov. 21, 2013

(51) Int. Cl.
*E21B 19/16* (2006.01)
*E21B 19/00* (2006.01)
*E21B 7/02* (2006.01)

(52) U.S. Cl.
CPC . *E21B 19/00* (2013.01); *E21B 7/02* (2013.01); *E21B 19/163* (2013.01)

(58) Field of Classification Search
CPC ..... E21B 19/00; E21B 7/02; E21B 19/163
USPC ..... 175/81; 81/57.15, 57.16, 57.18, 57.19, 81/57.2, 57.21, 57.31, 57.33, 37.34; 294/203, 116, 113
See application file for complete search history.

(56) References Cited

U.S. PATENT DOCUMENTS

| | | | | | |
|---|---|---|---|---|---|
| 2,760,392 | A * | 8/1956 | Paget | ..... | 81/57.16 |
| 4,402,239 | A * | 9/1983 | Mooney | ..... | 81/57.16 |
| 4,403,666 | A * | 9/1983 | Willis | ..... | 175/85 |
| 5,653,297 | A * | 8/1997 | Whisenhunt | ..... | 175/52 |
| 5,740,703 | A * | 4/1998 | Perry | ..... | 81/57.34 |
| 6,047,775 | A * | 4/2000 | Mock | ..... | 166/377 |
| 6,298,926 | B1 * | 10/2001 | Dalkert et al. | ..... | 175/52 |
| 6,752,043 | B2 * | 6/2004 | Carlson | ..... | 81/57.16 |
| 8,453,542 | B2 * | 6/2013 | Gouws | ..... | 81/57.2 |
| 8,627,748 | B2 * | 1/2014 | Gouws | ..... | 81/57.19 |

* cited by examiner

*Primary Examiner* — Robert E Fuller
(74) *Attorney, Agent, or Firm* — John A. Thomas

(57) ABSTRACT

A rod support system has an upper gripper assembly and a lower gripper assembly. Each gripper assembly has a top plate having a first track. The first track has a first substantially arcuate portion having a first radius of curvature and a second substantially arcuate portion having a second and smaller radius of curvature. A jaw is constrained to move in a path defined by the first track. A bottom plate of the assembly has a second track that is congruent with the first track also engaging the jaw, so that the jaw is constrained to move in a path defined by the first track and the second track in cooperation. The jaws can support a rod when the jaws move from a position along the first arcuate portion of the first and second tracks to a position along the second arcuate portion of the first and second tracks.

22 Claims, 5 Drawing Sheets

ROD SUPPORT SYSTEM

BACKGROUND

1. Technical Field

This disclosure relates to mechanisms for manipulating sections of rod or pipe to form drill strings, in particular, to mechanisms for gripping and holding sections of rod transported in carousel-type racks.

2. Background

A type of drilling equipment known as a blast hole drill is widely used in surface mining and quarrying operations. This equipment is typically mobile, being mounted on a vehicle that travels on crawlers. The vehicle has a cab for operating personnel and a housing for the machinery that drives the unit. A long, pivoting mast is disposed horizontally when the unit is on the move, and is set upright for vertical drilling operations. The mast carries a number of individually stored rods or pipes arranged longitudinally therein. These rods are connected one at a time in a drill string as a hole is being drilled.

Blast hole equipment is used in surface mining and quarrying operations to drill holes of moderate depth. Explosives are lowered to the bottom of these holes and detonated to break up rock and other hard earth formations. This permits the excavation of the material disintegrated by the blast and allows expansion of the area being mined or quarried.

Carrousel-type rod loaders are generally used to accommodate both drill rods and drill collars. The carrousel rod loader typically has upper and lower indexing plates that are rigidly attached to a vertically disposed axle, which permits the two plates to rotate together as a unit. The plates have suitable openings for holding and positioning the drill rod.

In certain mining operations, it becomes advantageous to position the mast at an angle, up to 30 degrees, for example, to drill a hole at that angle. There is a problem, however, in connecting drill rods to an angular drill string. If the drilling operation were conducted on the vertical, the top section of rod would be suspended from a drill head and lowered to connect it at the end of the drill string that projects vertically upward from the hole. When drilling at an angle, a rod that is connected at its upper end to the drill head will not be suitably supported at its lower end to permit alignment with, and a threaded connection to, the drill string. Some means is typically required to grip and support the rod to be connected and aligned with the drive and the drill hole.

It is advantageous to have more drill rods in a carousel, but this implies that the rods are closer together and thus there is less room for a mechanism to grip and support a rod. Also, when the carousel is operated at an angle off the vertical, there is a greater tendency for the rods to sag and an increased risk that a rod will escape the gripping device as it is being indexed over the drill hole. What is needed is a system that will both adequately support sagging rods and also take up minimal room to allow for use with carousels holding multiple rods.

The reader should note that this disclosure is not limited to the handling of drill rods for blast-hole drilling, but is applicable to other types of drilling, such as for water wells or petroleum-producing wells, or the handling of tubular parts generally.

DRAWINGS

DESCRIPTION

Figure 1:
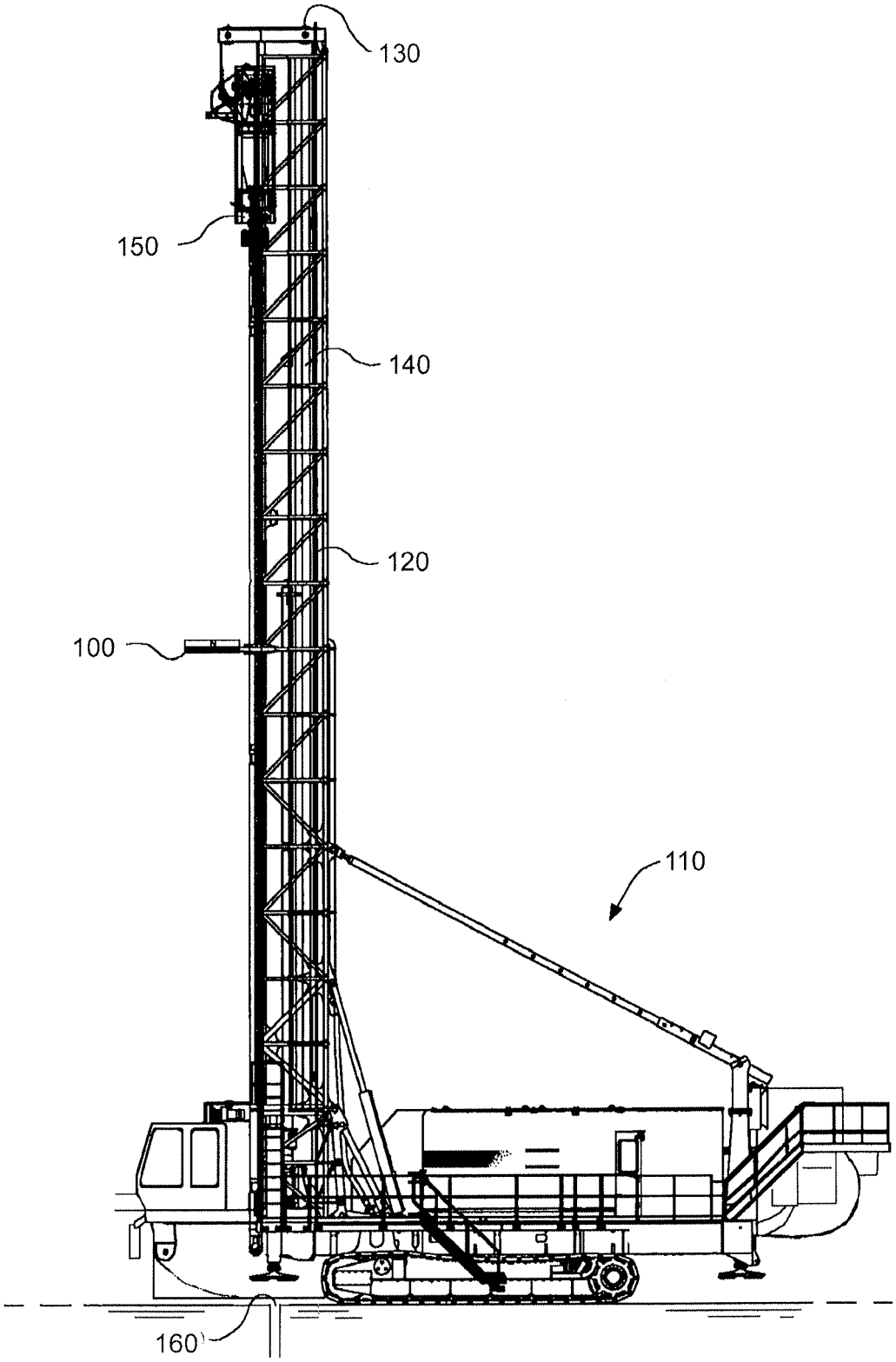
FIG. 1 depicts a typical blast hole rig, showing the carousel of rods and rod support system attached.

FIG. 1 shows a typical drilling rig (110) for blast-hole drilling, having a rod carousel (120) in its tower (130) for holding several drilling rods (140). The rods (140) are sequentially moved into drilling position under a top drive (150). A rod-support system (100) is shown pivotally connected to the tower (130). Generally, the rod-support system (100) grasps and stabilizes the rod (140) and insures that it is aligned over the drill hole (160) so as to be coupled to the rod (140) preceding it in the hole (160).

Figure 2:
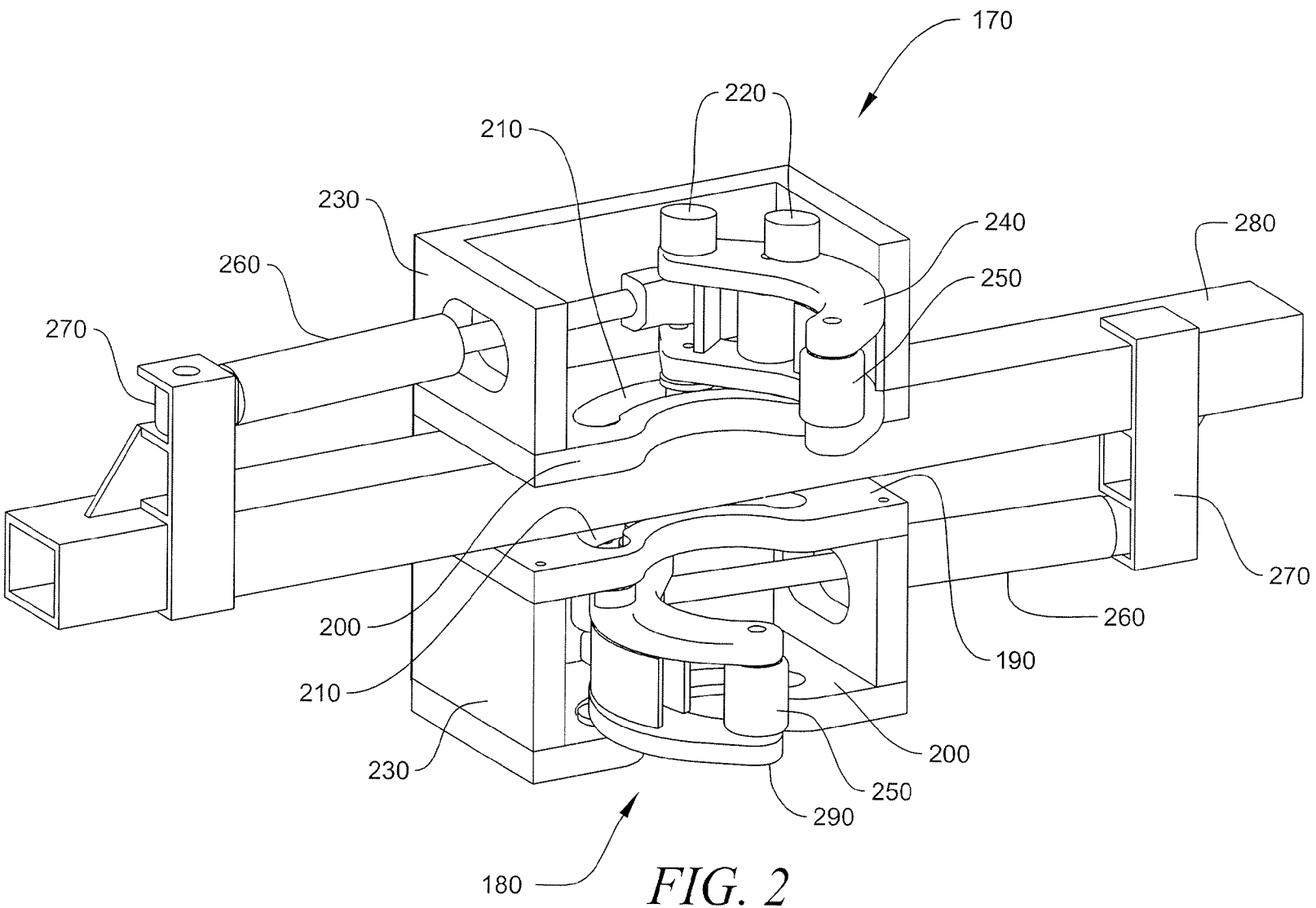
FIG. 2 is a perspective view of jaw boxes of an embodiment.

FIG. 2 depicts an embodiment having an upper jaw assembly (170) and a lower jaw assembly (180). In this embodiment, the jaw assemblies (170, 180) are mounted in a box arrangement, each box having a top plate (190) and a bottom plate (200), spaced apart by side plates (230). The reader should understand that other framing or support structure may be used to fix the top plate (190) and the bottom plate (200) in the relationships shown. An upper jaw (240) is movably located in the upper jaw assembly (170). The upper jaw (240) is constrained to move in a substantially arcuate path, described in more detail below, by means of cam followers (220) connected to the upper jaw (240) and following an arcuate track (210) in the top plate (190). A hydraulic cylinder (260) is fastened with a mount (270) to a support arm (280), and the piston rod thereof is fastened with a pivoting connection (300) at one end of the upper jaw (240). As the piston of the hydraulic cylinder (260) extends, the jaw (240) is forced to move outward from the jaw assembly (170) along the path determined by the tracks (210). The upper and lower tracks (210) in the top plate (190) and the bottom plate (200) are substantially congruent, so that cam followers (220) engaging the tracks (210) equally constrain the motion of the jaw (240).

In practice, it is advantageous to have a second jaw assembly (180) to grip the rod (140) from an opposing direction. The lower jaw assembly (180) functions in a similar way, except that the motion of the lower jaw (290) is opposing to that of the upper jaw (240). This opposing motion is determined by the arcuate path of the tracks (210) as discussed below. Together, the upper jaw assembly (170) and the lower jaw assembly (180) constitute the gripper assembly (105) of the rod support system (100).

In use, the rod support arm (280) supporting the upper jaw assembly (170) and the lower jaw assembly (180) is pivotably connected to the tower (130) of a drill rig (110) for handling the rods (140) in a rod carousel (120) as discussed above.

Figure 3:
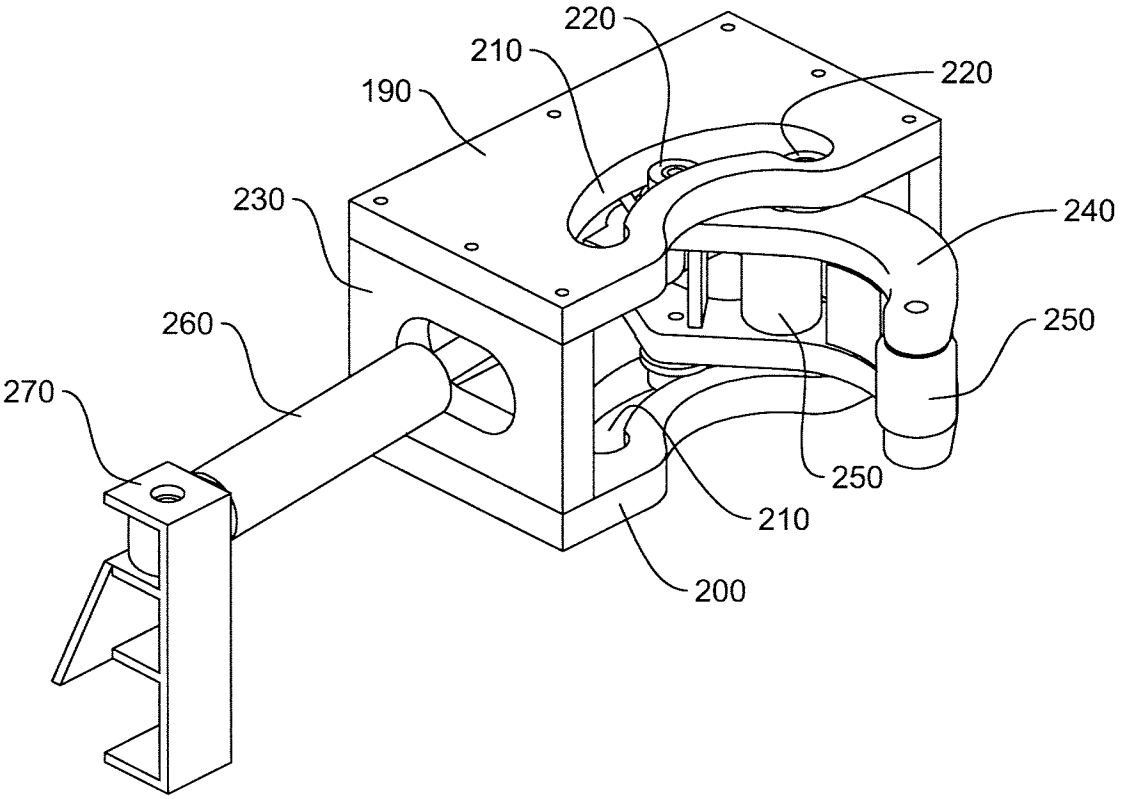
FIG. 3 is a perspective view of one jaw box of an embodiment.

FIG. 3 shows the upper jaw assembly (170) in more detail. The roller cam followers (220), one or more, are preferably roller bearings bolted to the jaw (240) on either side thereof. A suitable example of such a bearing is the Load Runner, manufactured by Osborn International, Inc. Preferably, rollers (250) are attached to the jaw (240) to smooth movement of the jaw (240) around the drill rod (140), as described in more detail below.

First Embodiment

Figure 4:
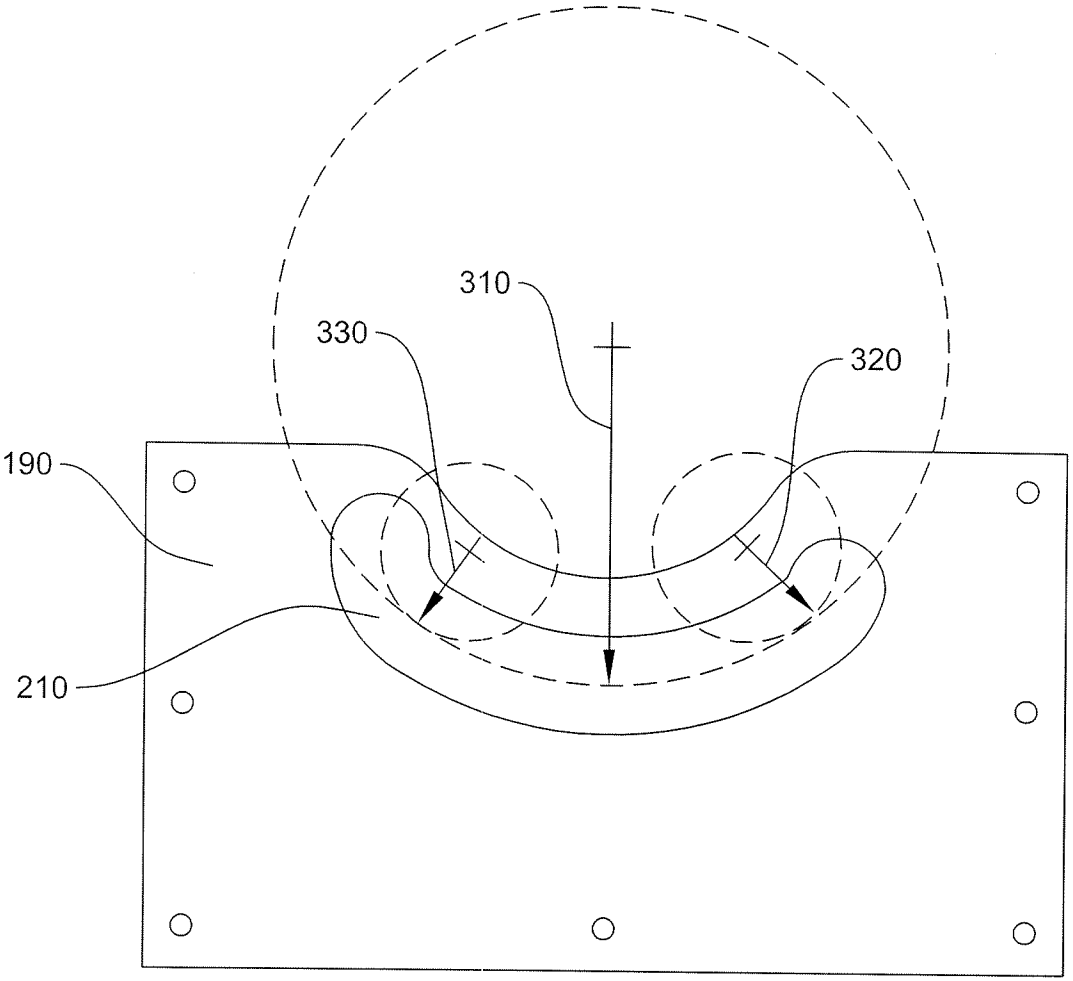
FIG. 4 depicts a typical track plate of an embodiment, showing substantially arcuate portions thereof.

FIG. 4 shows the track (210) in a top or bottom plate (190, 200). The track (210) has two arcuate sections, the first and larger thereof having a first radius of curvature (310), and the second and smaller thereof having a smaller radius of curvature (320). The track (210), considered in its entirety, is therefore non-circular. As the jaw (240), constrained in its movement by the cam followers (220) in the track (210), moves from the portion of the track (210) having the larger radius of curvature (310) to the portion having the smaller radius of curvature (320), the jaw (240) is thrust outward from the jaw assembly (170), enlarging its grasp of a rod (140) sought to be gripped.

Second Embodiment

FIG. 5 also shows a second embodiment having a third radius of curvature (330) at the end of the track (210) opposing the second and smaller radius of curvature (320) just discussed. The third radius of curvature (330) defines a third substantially arcuate portion of the track, smaller than the main first radius of curvature (310) just discussed. The addition of the third substantially arcuate portion pulls the jaw (240) an additional distance toward axis of the drill hole (160), thus aiding in aligning a sagging rod (140) over the drill hole (160).

In either embodiment, the second track (210) in the bottom plate (200) slidably engages the jaw (240), where the jaw (240) is constrained to slidably move in a path defined by the tracks (210) in cooperation, so that the jaw (240) is capable of moving to a position to support a rod (140) when the jaw (240) moves from a position along the first arcuate portion of the tracks (210) to a position along the second arcuate portion of the tracks (210).

Figure 5A:
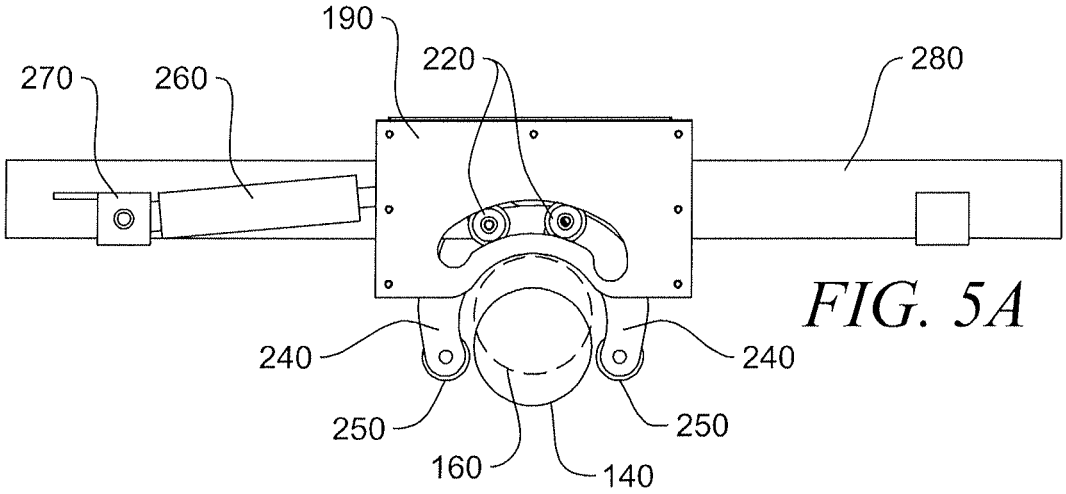
FIG. 5 is a plan view showing three stages of an embodiment of the rod support system engaging a rod.
Figure 5B:
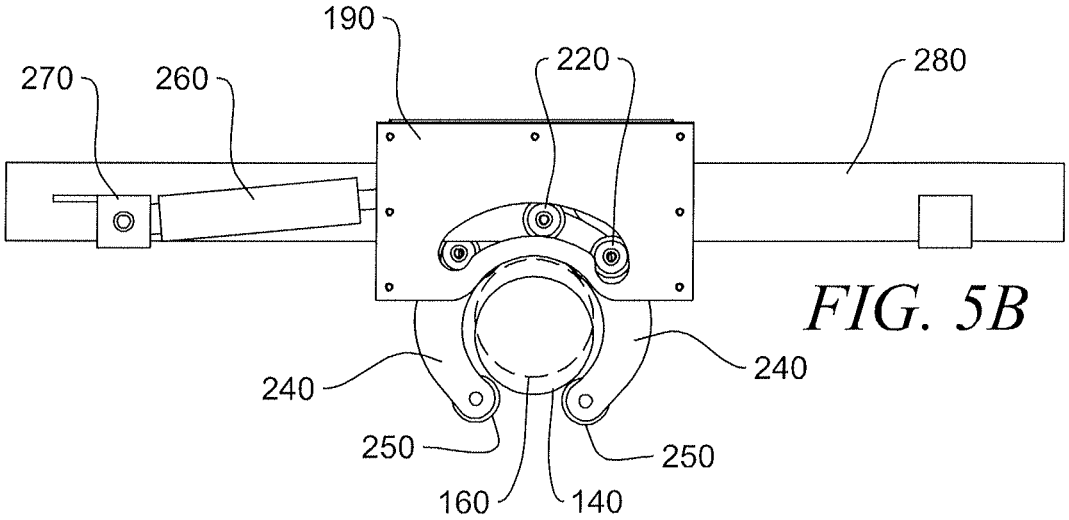
Figure 5C:
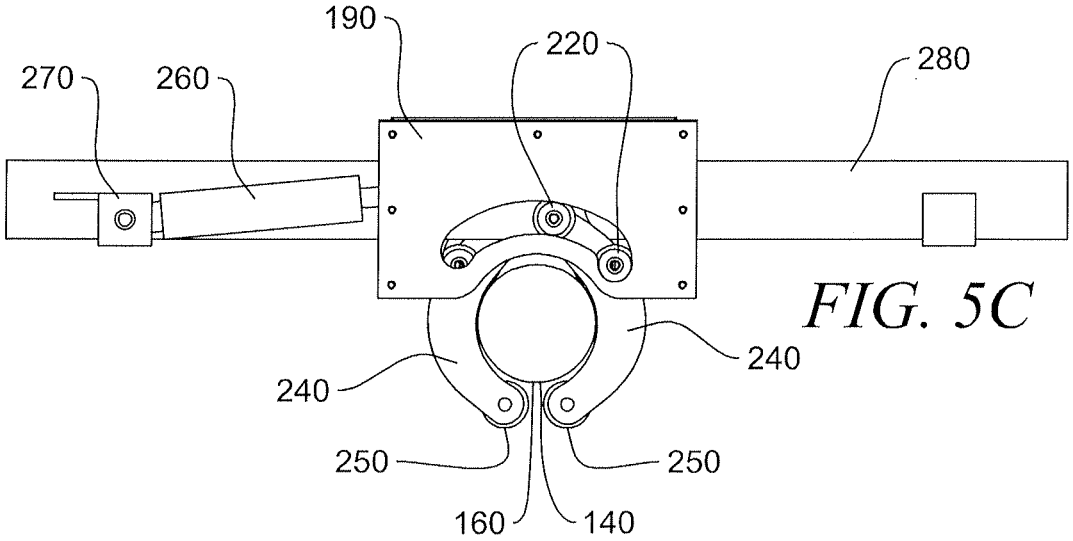

FIG. 5 schematically shows an embodiment of the rod support system (100) engaging a rod (140) from a typical rod carousel (120). In FIG. 5A, the upper jaw (240) and the lower jaw (290) are open to receive a rod (140) from the rod carousel (120). The location of the drill hole (160) relative to the rod is shown in dashed outline. Typically, because of misalignment or sag, the rod (140) is not indexed directly with the axis of the drill hole (160). As a result, there is a likelihood with prior-art rod support systems that the gripping mechanism will not completely engage the rod (140), or the rod (140) will slip from its grasp. In FIG. 5B, the upper jaw (240) and the lower jaw (290) are pushed along the track (210) in the top plate (190) and the lower plate (200) and thus pivot to engage the rod (140). In FIG. 5C, the jaws (240, 290) are pushed so that the cam followers (220) engage the portion of the tracks (210) with the smaller radius of curvature (320), thus forcing the jaws (240, 290) farther around the circumference of the rod (140) and supporting it firmly.

In summary, a rod support system comprises a gripper assembly (105) that further comprises a top plate (190), the top plate (190) having a track (210). The track (210) has a first substantially arcuate portion having a first radius of curvature (310), and a second substantially arcuate portion having a second and smaller radius of curvature (320). A jaw (240) is constrained to slidably move in a path defined by the track (210). A bottom plate (200) has a second track (210) congruent with the first track (210). Besides gripping a rod (140) more firmly and pulling up a sagging rod (140) toward the axis of the drill hole (160), the rod support system allows for larger drill rods in a smaller carousel.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

We claim:

1. A rod support system, comprising:
a gripper assembly comprising:
a top plate,
the top plate having a first track;
the first track defining a first path;
the first path having a first substantially arcuate portion having a first radius of curvature, and a second substantially arcuate portion having a second and smaller radius of curvature;
a jaw; the jaw constrained to slidably move in the first path;
a bottom plate; the bottom plate having a second track;
the second track defining a second path;
the second path congruent with the first path;
the second track slidably engaging the jaw, where,
the jaw is constrained to slidably move according to the first path and the second path in cooperation;
so that the jaw is capable of moving to a position to support a rod when the jaw moves from a position along the first arcuate portion of the first and second paths to a position along the second arcuate portion of the first and second paths.

2. The rod support system of claim 1, where the gripper assembly is an upper gripper assembly; and,
the rod support system further comprises a lower gripper assembly;
the lower gripper assembly comprising:
a top plate,
the top plate having a first track;
the first track defining a first path;
the first path having a first substantially arcuate portion having a first radius of curvature, and a second substantially arcuate portion having a second and smaller radius of curvature;
a jaw; the jaw constrained to slidably move in the first path;
a bottom plate; the bottom plate having a second track;
the second track defining a second path;
the second path congruent with the first path;
the second track slidably engaging the jaw, where,
the jaw is constrained to slidably move according to the first path and the second path in cooperation;
so that the jaw is capable of moving to a position to support a rod when the jaw moves from a position along the first arcuate portion of the first and second paths to a position along the second arcuate portion of the first and second paths; and,
where the lower gripper assembly is positioned with respect to the upper gripper assembly so that the centers of curvature of the arcuate portions of the first and second paths of the respective upper and lower gripper assemblies are substantially coaxial.

3. The rod support system of claim 2 where the path of the jaw of the upper gripper assembly and the path of the jaw of the lower gripper assembly are opposing, so that the jaw of the upper gripper assembly and the jaw of the lower gripper assembly are capable of closing toward one another when moved and so cooperate to grip a rod.

4. The rod support system of claim 1, where the jaw is constrained to move along the first path by at least one cam follower connected to the jaw.

5. The rod support system of claim 1, where the jaw is constrained to move along the second path by at least one cam follower connected to the jaw.

6. The rod support system of claim 5 further comprising first and second hydraulic cylinders, where the jaws of the upper gripper assembly and the lower gripper assembly are forced to move by cooperating extension or retraction of the first and second hydraulic cylinders.

7. The rod support system of claim 1 further comprising a hydraulic cylinder pivotably connected to the jaw, where the jaw is forced to move in the cooperating first and second paths by the extension or retraction of the hydraulic cylinder.

8. The rod support system of claim 1 where the jaw further comprises rollers.

9. A blast hole drilling rig, comprising:
a tower;
a rod carousel located within the tower;
a rod support system connected to the tower; the rod support system comprising:
a gripper assembly; the gripper assembly comprising:
a top plate,
the top plate having a first track;
the first track defining a first path;
the first path having a first substantially arcuate portion having a first radius of curvature, and a second substantially arcuate portion having a second and smaller radius of curvature;
a jaw; the jaw constrained to slidably move in the first path;
a bottom plate; the bottom plate having a second track;
the second track defining a second path;
the second path congruent with the first path;
the second track slidably engaging the jaw, where,
the jaw is constrained to slidably move according to the first path and the second path in cooperation;
so that the jaw is capable of moving to a position to support a rod when the jaw moves from a position along the first arcuate portion of the first and second paths to a position along the second arcuate portion of the first and second paths.

10. The blast hole drilling rig of claim 9, where the gripper assembly is an upper gripper assembly; and,
the rod support system further comprises a lower gripper assembly;
the lower gripper assembly comprising:
a top plate,
the top plate having a first track;
the first track defining a first path;
the first path having a first substantially arcuate portion having a first radius of curvature, and a second substantially arcuate portion having a second and smaller radius of curvature;
a jaw; the jaw constrained to slidably move in the first path;
a bottom plate; the bottom plate having a second track;
the second track defining a second path;
the second path congruent with the first path;
the second track slidably engaging the jaw, where,
the jaw is constrained to slidably move according to the first path and the second path in cooperation;
so that the jaw is capable of moving to a position to support a rod when the jaw moves from a position along the first arcuate portion of the first and second paths to a position along the second arcuate portion of the first and second paths; and,
where the lower gripper assembly is positioned with respect to the upper gripper assembly so that the centers of curvature of the arcuate portions of the first and second tracks of the respective upper and lower gripper assemblies are substantially coaxial.

11. The blast hole drilling rig of claim 10 where the path of the jaw of the upper gripper assembly and the path of the jaw of the lower gripper assembly are opposing, so that the jaw of the upper gripper assembly and the jaw of the lower gripper assembly are capable of closing toward one another when moved and so cooperate to grip a rod.

12. The blast hole drilling rig of claim 9, where the jaw is constrained to move along the first path by at least one cam follower connected to the jaw.

13. The blast hole drilling rig of claim 9, where the jaw is constrained to move along the second path by at least one cam follower connected to the jaw.

14. The blast hole drilling rig of claim 13, further comprising first and second hydraulic cylinders, where the jaws of the upper gripper assembly and the lower gripper assembly are forced to move by cooperating extension or retraction of the first and second hydraulic cylinders.

15. The blast hole drilling rig of claim 9 further comprising a hydraulic cylinder pivotably connected to the jaw, where the jaw is forced to move in the cooperating first and second paths by the extension or retraction of the hydraulic cylinder.

16. The blast hole drilling rig of claim 9, where the jaw further comprises rollers.

17. A rod support system, comprising:
a gripper assembly comprising:
a top plate,
the top plate having a first track;
the first track defining a first path;
the first path having a first substantially arcuate portion having a first radius of curvature, and a second substantially arcuate portion having a second radius of curvature smaller than that of the first substantially arcuate portion, and a third substantially arcuate portion having a third radius of curvature smaller than that of the first substantially arcuate portion;
a jaw; the jaw constrained to slidably move in the first path;
a bottom plate; the bottom plate having a second track;
the second track defining a second path;
the second path congruent with the first path;
the second track slidably engaging the jaw, where,
the jaw is constrained to slidably move according to the first path and the second path in cooperation;
so that the jaw is capable of moving to a position to support a rod when the jaw moves from a position along the first arcuate portion of the first and second paths to a position along the second arcuate portion of the first and second paths.

18. The rod support system of claim 17, where the jaw is constrained to move along the first path by at least one cam follower connected to the jaw.

19. The rod support system of claim 17, where the jaw is constrained to move along the second path by at least one cam follower connected to the jaw.

20. The rod support system of claim 19 further comprising first and second hydraulic cylinders, where the jaws of the upper gripper assembly and the lower gripper assembly are forced to move by cooperating extension or retraction of the first and second hydraulic cylinders.

21. The rod support system of claim 17 further comprising a hydraulic cylinder pivotably connected to the jaw, where the jaw is forced to move in the cooperating first and second paths by the extension or retraction of the hydraulic cylinder.

22. The rod support system of claim 17 where the jaw further comprises rollers.

* * * * *